2/18/86 XR 4,570,753

United States Patent [19]

Ohta et al.

[11] Patent Number: 4,570,753

[45] Date of Patent: Feb. 18, 1986

[54] ELEVATOR HOISTING DEVICE

[75] Inventors: Kazutoshi Ohta; Katsuhiko Suzuki, both of Nagoya, Japan

[73] Assignee: Mitsubishi Denki Kabushiki Kaisha, Tokyo, Japan

[21] Appl. No.: 536,458

[22] Filed: Sep. 28, 1983

[30] Foreign Application Priority Data

Oct. 4, 1982 [JP] Japan ..... 57-174142

[51] Int. Cl.[4] ..... B66B 9/00

[52] U.S. Cl. ..... 187/1 R; 187/94; 310/12; 318/135

[58] Field of Search ..... 187/1 R, 43, 39, 28, 187/17, 20, 94, 29 R; 310/12; 318/135

[56] References Cited

U.S. PATENT DOCUMENTS

| | | | |
|---|---|---|---|
| 2,636,139 | 4/1953 | Winget | 310/12 |
| 4,217,507 | 8/1980 | Jaffe et al. | 310/12 |
| 4,402,386 | 9/1983 | Ficheux et al. | 187/29 R |
| 4,433,273 | 2/1984 | Petersen | 318/135 |

FOREIGN PATENT DOCUMENTS

| | | | |
|---|---|---|---|
| 165487 | 10/1955 | Australia | 310/12 |
| 47-46094 | 11/1972 | Japan . | |
| 0134312 | 10/1979 | Japan | 318/135 |
| 63566 | 5/1980 | Japan | 310/12 |

*Primary Examiner*—Joseph J. Rolla
*Assistant Examiner*—Kenneth Noland
*Attorney, Agent, or Firm*—Wenderoth, Lind & Ponack

[57] ABSTRACT

An elevator hoisting device including a stator forming a primary side of a linear motor disposed on an wall of a hoistway adjacent to its ceiling, a tape-shaped amorphous metallic member for hanging down over a pulley to support at opposite ends thereof an elevator car and a counter weight so as to cause its pendent portion connected to the counter weight to be close to the stator through a non-magnetic member with a low coefficient of friction to form a secondary conductor of the linear motor. The non-magnetic member and therefore the adjacent surface of the stator is somewhat tilted to the vertical downward toward the wall of the hoistway.

4 Claims, 2 Drawing Figures

ELEVATOR HOISTING DEVICE

BACKGROUND OF THE INVENTION

This invention relates to an elevator hoisting device for hoisting an elevator car by a linear motor including a stator on the primary side disposed on the side of a building served by the elevator car.

Known linear motors for hoisting an elevator car are divided into two types one of which has the stator forming a primary side thereof disposed on the side of the moving member such as the counter weight, and the other type of which has the stator disposed on the side of a building served by an associated elevator car. In either case, an elevator car is connected to one end of a rope trained over a sheave disposed adjacent to a ceiling of an associated hoistway and connected at the other end to a counter weight. Thus the rope hangs the elevator car and the counter weight in an balanced state.

In the one type of linear motors a secondary electrical conductor is disposed in electrically insulating relationship on one wall of the hoistway to extend substantially the entire a height of the hoistway so as to cause the stator on the counter weight to travel along the same with a predetermined small gap formed therebetween while the secondary conductor is supplied with electric power through an electrical conductor connected to the stator.

In the other type of linear motors a plurality of stators forming the primary side thereof are disposed in vertically aligned, spaced relationship on one wall of the hoistway, one for each floor of the building, so that a secondary conductor disposed on the counter weight travels along the aligned stators with predetermined equal small gap formed between the same and the stators.

Either type of linear motors is advantageous in that a penthouse located above the hoistway is low in height because the hoisting motor and the hoisting device are not disposed within the penthouse.

With the stator disposed on the side of the counter weight, there is also the advantage that only a single linear motor is required but it is difficult to realize a high current cable having a long lifetime in view of the supply of an electrical power to the moving member such as the counter weight. Furthermore the secondary electrically conductor must be disposed on the side of the building resulting in an economic disadvantage.

On the other hand, with the stator disposed on the side of the building, a plurality of stators must be disposed in vertically aligned, spaced relationship on the side of the building to extend substantially the entire height thereof resulting also in an economic disadvantage.

Accordingly, it is an object of the present invention to eliminate the difficulty and disadvantages of the prior art practice as described above by the provision of an elevator hoisting device for driving an elevator car by a linear motor including no electrical conductor for supplying an electrical power to an associated moving member and capable of decreasing the number of the components thereof disposed on the side of a building served by an associated elevator car.

SUMMARY OF THE INVENTION

The present invention provides an elevator hoisting device comprising a stator forming a primary side of a linear motor and disposed on the side of a building served by an associated elevator car, and at least one metallic member in the form of a tape for hanging down the elevator car and a counter weight through both ends thereof so that a pendent portion of the metallic member connected to the counter weight is close to the stator, the metallic member being vertically driven with a magnetic force from the stator to serve the function of a secondary electrical conductor of the linear motor.

Preferably a non-magnetic member having a low coefficient of friction may be disposed between the stator and a portion of the metallic member opposite to the stator.

BRIEF DESCRIPTION OF THE DRAWING

The present invention will become more readily apparent from the following detailed description taken in conjunction with the accompanying drawing in which.

DESCRIPTION OF THE PREFERRED EMBODIMENT

Figure 1:
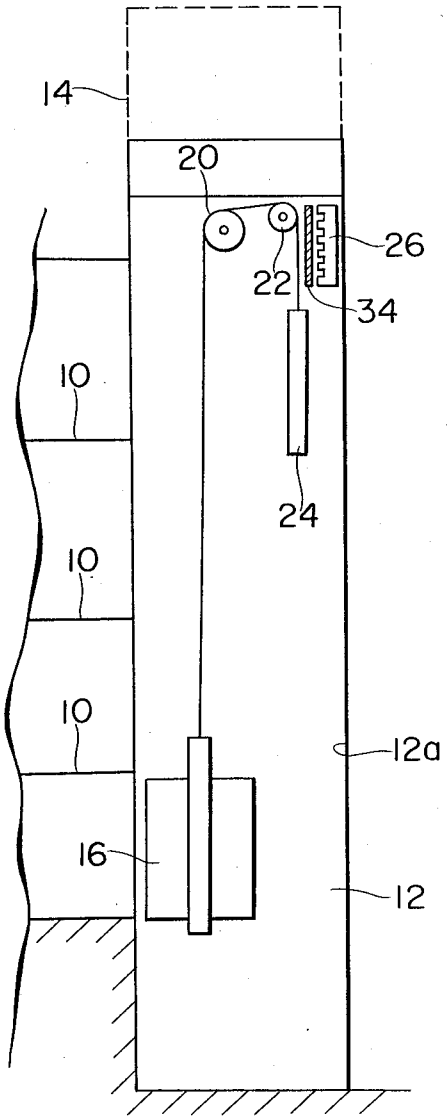
FIG. 1 is a fragmental schematic elevational view of one embodiment according to the elevator hoisting device of the present invention with parts illustrated in section.

Referring now to FIG. 1 of the drawing, there is illustrated one embodiment according to the elevator hoisting device of the present invention. The arrangement illustrated comprises a plurality of floors 10, in this case, four floors disposed in vertically spaced relationship within a building, a hoistway 12 vertically extending substantially the entire height of the building, and a penthouse 14 disposed on the top wall of the building above the hoistway 12.

Within the hoistway 12 an elevator car 16 is connected to one end of a rope 18 trained over both a pulley 20 located adjacent to a ceiling of the hoistway 12 and another pulley 22 disposed adjacent to the pulley 20 to be somewhat higher in level than the pulley 20. The rope 18 is connected at the other end to a counterweight 24. Thus the rope 18 hangs down the elevator car 16 and the counter weight 24 in a balanced state while that portion of the rope 18 pendent from the pulley 22 is fairly close to that wall surface 12*a* of the hoistway 12 opposite to floor doors for the respective floors 10 for the purpose as will be apparent later.

According to the present invention the rope 18 is formed of at least one metallic member in the formed of a tape and a single stator 26 is disposed on the wall surface 12*a* of the hoistway 12 adjacent to the ceiling thereof to form a primary side of a linear motor.

Figure 2:
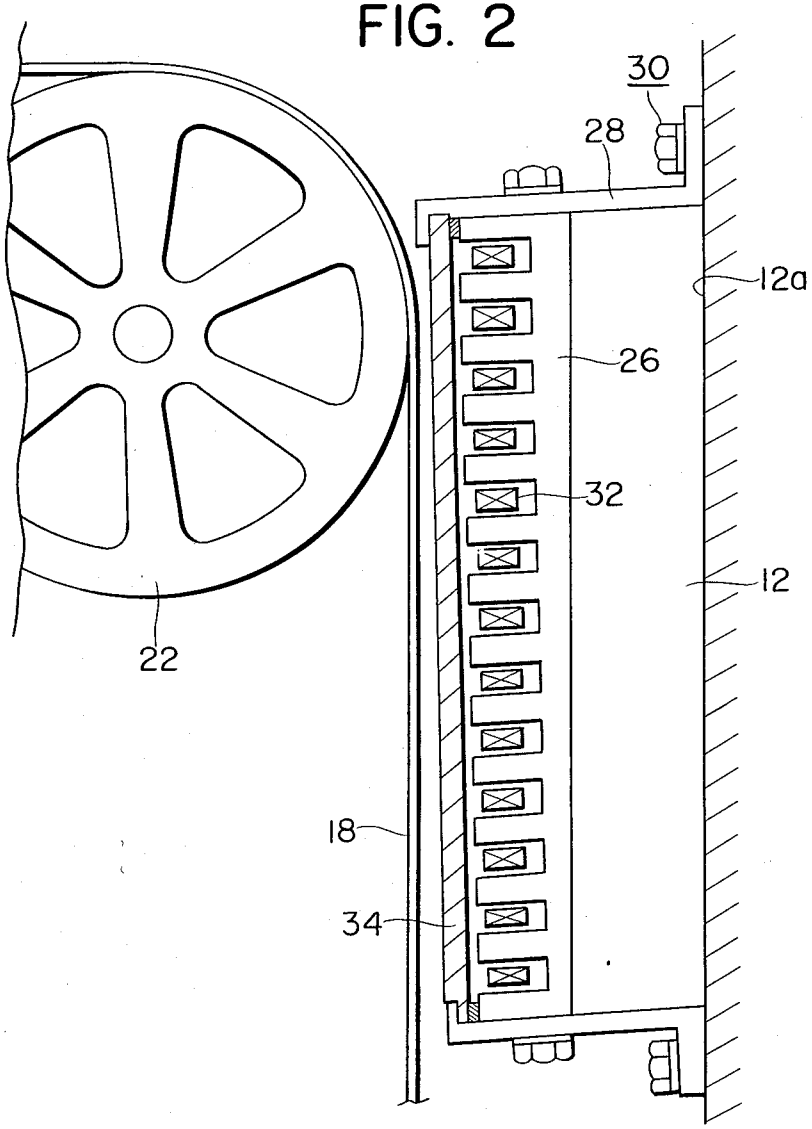
FIG. 2 is a fragmental elevational view in an enlarged scale of the stator shown in FIG. 1 and the adjacent components.

As shown best in FIG. 2, the stator 26 is mounted to fittings 28 through bolts and then the fittings 28 are fixed to the wall surface 12*a* of the hoistway 12 through bolts 30. The stator 26 includes one surface facing in parallel relationship the wall surface 12*a* of the hoistway 12 and the other or opposite surface somewhat tilted to the vertical toward the wall surface 12*a* from the upper end to the lower end thereof. The stator 26 also includes a plurality of parallel grooves disposed at predetermined equal intervals to open in the other surface and motor coils 32 respectively fitted into those grooves.

A non-magnetic member 34 is mounted to the fittings 28 so that it is parallel to the other surface of the stator 26 through a predetermined constant spacing. Thus the non-magnetic member 34 is similarly tilted to the vertical as is the other surface of the stator 26. Also, the non-magnetic member 34 is coated with a fluorocarbon polymer such as is commercially available under the Teflon trademark so as to have a low coefficient of friction.

The tape-shaped metallic member 18 leaving the pulley 22 is arranged to vertically travel past the non-magnetic member 34 with a narrow gap therebetween which gradually increases in the downward direction with the surface thereof facing the non-magnetic member 34. Thus, the metallic member 18 forms a secondary electrical conductor of the linear motor.

In operation, the stator 26 generates a magnetic force which, in turn, exerts on the metallic member 18 a force for driving the metallic member 18, and therefore the elevator car 16, upward or downward as the case may be with the result that the floors 10 are served by the elevator car 16 as the elevator car 16 and counterweight 24 move between the position shown and FIG. 1 where counterweight 24 is adjacent pulley 22, and where elevator car 16 is adjacent the pulley 22.

At that time the tape-shaped metallic member 18 is necessarily attracted by the stator 26 forming the primary side of the linear motor. However this attraction of the metallic member 18 can be prevented from adversely affecting the system because the metallic member 18 is contacted by the non-magnetic member 34 having a low coefficient of friction and the gap therebetween gradually increases toward the lower end of the non-magnetic member 34.

Furthermore, the taped-shaped metallic member is preferably formed of an amorphous metallic member. This is because the use of the amorphous metallic material improves the resulting mechanical strength and also the magnetic characteristics of the metallic member 18.

In summary, the present invention provides an elevator hoisting device comprising a single stator disposed on the side of an associated building to form a primary side of a linear motor, and a metallic member in the form of a tape hanging down an elevator car and a counter weight and serving as a secondary conductor of the linear motor. Furthermore a non-magnetic member with a low coefficient of friction may be interposed between the stator on the primary side and the tape-shaped metallic member to solve a problem that the metallic member is attracted by the stator. Therefore it is not required to supply high electric power to a moving member, in this case, the tape-shaped metallic member. Also, it is not required to dispose a linear motor along the entire height of the particular building resulting in an economical elevator system using minimal space.

While the present invention has been illustrated and described in conjunction with a single preferred embodiment, it is to be understood that numerous changes and modifications may be resorted to without departing from the spirit and scope of the present invention.

What is claimed is:

1. An elevator hoisting device, comprising a linear motor having a stator for being disposed on the side of a building and forming the primary side of said motor;

an elevator car;

a counterweight;

at least one longitudinally extending tape-shaped metallic member, continuously flexible all along its length, connected at opposite ends thereof to said elevator car and said counterweight; and means for engaging said member intermediate said opposite ends at a location above said elevator car and said counterweight so as to vertically support said member, said elevator car and said counterweight, said member being movable longitudinally with respect to said means so as to move said elevator car and counterweight in opposite vertical directions therewith, the portion of said member between said location and said counterweight being located close to said stator so as to be vertically driven by magnetic forces from said stator, whereby said portion functions as a secondary electrical conductor of said linear motor;

said elevator car and said counterweight being movable with said member between first positions in which said elevator care is adjacent said engaging means and said counterweight is substantially below said engaging means, and second positions in which said counterweight is adjacent said engaging means and said elevator car is substantially below said engaging means, said stator being located adjacent said engaging means so as to oppose said portion when said elevator car and said counterweight are in either of said first positions and said second positions;

said portion of said member including a vertically extending uppermost part, said stator having a front face opposing said uppermost part and tilted downwardly and away from said uppermost part.

2. An elevator hoisting device as in claim 1, wherein said metallic member is formed of an amorphous metallic material.

3. An elevator hoisting devices as in claim 1, further comprising a non-magnetic member having a low coefficient of friction disposed between said stator and said portion of said metallic member close to said stator.

4. A elevator hoisting device as in claim 1, wherein said stator is located on only one side of said member.

* * * * *